US006479932B1

(12) United States Patent
Nunomura

(10) Patent No.: US 6,479,932 B1
(45) Date of Patent: Nov. 12, 2002

(54) AC PLASMA DISPLAY PANEL

(75) Inventor: Keiji Nunomura, Tokyo (JP)

(73) Assignee: NEC Corporation, Tokyo (JP)

( * ) Notice: Subject to any disclaimer, the term of this patent is extended or adjusted under 35 U.S.C. 154(b) by 0 days.

(21) Appl. No.: 09/400,307

(22) Filed: Sep. 21, 1999

(30) Foreign Application Priority Data

Sep. 22, 1998 (JP) ..... 10-284738
Sep. 28, 1998 (JP) ..... 10-288686

(51) Int. Cl.[7] ..... H01J 11/02

(52) U.S. Cl. ..... 313/582; 313/585; 313/586; 345/60; 345/41

(58) Field of Search ..... 345/60, 41, 55; 313/586, 584, 585, 582; 315/169.4

(56) References Cited

U.S. PATENT DOCUMENTS 5,742,122 A * 4/1998 Amemiya et al. ..... 313/582
6,172,461 B1 * 1/2001 Ha ..... 313/587 X
6,229,261 B1 * 5/2001 Kim ..... 313/585 X

FOREIGN PATENT DOCUMENTS

| | | |
|---|---|---|
| JP | 03-190039 | 8/1991 |
| JP | 04-36931 | 2/1992 |
| JP | 05-250993 | 9/1993 |
| JP | 05290741 | 11/1993 |
| JP | 06-44907 | 2/1994 |
| JP | 07-295507 | 11/1995 |
| JP | 8-31573 | 2/1996 |
| JP | 8-250029 | 9/1996 |
| JP | 8-315735 | 11/1996 |
| JP | 09-167565 | 6/1997 |
| JP | 09-237580 | 9/1997 |
| JP | 10-233171 | 9/1998 |
| JP | 10-321142 | 12/1998 |
| JP | 2000-11899 | 1/2000 |

* cited by examiner

*Primary Examiner*—Ashok Patel
(74) *Attorney, Agent, or Firm*—Sughrue Mion, PLLC

(57) ABSTRACT

Described herein is an AC plasma display panel in which a discharge part is separated from a bus electrode and a partition wall. In this AC plasma display panel, a high emission efficiency can be obtained. Also described is another AC plasma display panel in which a data electrode having a large width part around the surface discharging gap and a narrow width part. The data electrode may further include a medium width part. In this AC plasma display panel, since counter discharge always occurs near a discharge gap of a scanning electrode by employing the data electrode having a specified shape, a high resolution panel with full-color display can be realized.

7 Claims, 21 Drawing Sheets

AC PLASMA DISPLAY PANEL

BACKGROUND OF THE INVENTION (a) Field of the Invention

The present invention relates to an AC plasma display panel (AC-PDP) for use in a flat panel television set and in a flat panel display unit, more in detail to the AC-PDP which realizes a high emission efficiency and improves display drive performance.

(b) Description of the Related Art

A color plasma display excites a fluorescent substance to make an emission display by means of a ultraviolet ray generated by gas discharge, and an application of the display panel to a large-screen television set is expected. Various systems have been developed for the color PDPs among which a reflection-type AC coplanar switching plasma display panel (AC-IPS-PDP) is excellent in its brightness and ease of manufacture.

FIGS. 1A to 1C show a typical reflection-type ACIPS-IPS-PDP. FIG.1A is an elevational view partially in section of a rear substrate, FIG. 1B is a side sectional view of a front substrate and FIG. 1C is a horizontal sectional view of the rear substrate.

A front substrate 100 disposed at a display side has a plurality of stripe transparent electrodes 13 and a plurality of narrow bus electrodes 14 extending in parallel on a glass substrate 11. An indium-tin oxide thin film or a tin oxide thin film is employed as the transparent electrode 13 which results in a large resistance of the transparent electrode 13. For compensating the large resistance of the transparent electrode 13, the bus electrode 14 is made from a good conductor metal such as silver in the form of a thick film, copper, aluminum and chromium in the form of a thin film to provide a high discharge current for sufficient emission in a large display unit. A dielectric layer 18 and a protection layer 19 are formed on the transparent electrode 13 and the bus electrode 14. The dielectric layer 18 may be formed as a transparent insulation layer having a thickness of about 20 to 40 micrometers by applying low melting point glass paste to the glass substrate 11 and sintering the glass substrate 11 at a high temperature slightly below 600° C. The protection layer 19 is formed by, for example, vacuum-evaporation of a magnesium oxide to form a thin film having a large secondary electron radiation coefficient and an excellent anti-sputtering ability.

After stripe data electrodes 16 are formed on a glass substrate 12, a dielectric layer 21 including low-melting point glass as a main component is formed. After stripe partition walls 17 are formed, powdery fluorescent substances 20 of red, green and blue are sequentially applied on a bottom surface and a side surface of a trench formed by the partition walls 17 to complete a rear substrate 200. The partition walls 17 not only secure a discharge space but also prevent cross-talk of the discharge and seepage of a luminous color, and ordinarily have a width of 30 to 100 micrometers and a height of 60 to 200 micrometers. After the rear substrate 200 and the front substrate 100 are coupled and the periphery of the both substrates is sealed with frit glass, a panel is completed by heating the substrates, exhausting an inner gas and finally enclosing a discharge gas having a rare gas as a main component therein.

A pair of the transparent electrodes 13 are separated by a discharge gap 23. One of the transparent electrodes acts as a scanning electrode 31 and the other acts as a maintaining electrode 32, and various voltage waveforms are applied to the two transparent electrodes and the data electrode for driving.

A simple example of a basic driving of the electrodes is shown in FIG. 2. Data pulses having a polarity reverse to the polarity of scanning pulses are applied to the data electrode 16 depending on display data of the scanning electrode in the cell in timing with the scanning pulses having a negative polarity sequentially applied to the selected scanning electrode 31 Thereby, a counter discharge occurs between the scanning electrode 31 and the data electrode 16 The counter discharge as a trigger generates a surface discharge between the maintaining electrode 32 and the scanning electrode 31 to complete a write operation. The write discharge generates a wall charge on the surfaces of the maintaining electrode 32 and the scanning electrode 31. While the maintaining discharge for the surface discharge is generated by the maintaining pulse applied between the maintaining electrode 32 and the scanning electrode 31 during a maintaining period in the cell in which the wall charge is formed, the maintaining discharge is not generated in the cell in which the write operation is not conducted even if a maintaining pulse is applied because electric fields generated by the wall charges are not superimposed. The application of the desired number of the maintaining pulses generates a specified emission display. Gray scale display can be realized by repeating the write operation and the maintaining discharge operation every sub-field. A preliminary discharge operation in which compulsory discharge is conducted by applying high voltages to all cells may be employed before the write operation as shown in FIG. 2 for elevating performance of the write operation. Although the driving system of separating the scanning emission and the maintaining emission is illustrated in FIG. 2, various driving systems have been proposed including a system in which the scanning pulse and the maintaining pulse are combined.

JP-A-8(1996)-315735 or JP-A-8(1996)-250029 describes a prior art of the PDP.

FIG. 3 shows another conventional AC plasma display panel having a coupling part 15, and FIG. 4 shows a conventional electrode structure.

In order to employ the AC color plasma display in a wide range of use such as in a television for home use in the prior art, a display driving performance may be, however, reduced even when an improved structure is employed for elevating an emission efficiency.

With increase of resolution and the number of display gray scales, an accurate write operation in a short period of time is required, a writing on one scanning electrode 31 in a full-color panel having 480 scanning electrodes is required to be performed in 3micro-seconds, and a write operation in a higher resolution panel such as that in a high precision television is required to be performed in 2 micro-seconds. However, in the conventional electrode structure, a position of starting counter discharge at a time of the write operation between the data electrode 16 and the scanning electrode 32 and a position of strong discharge are scattered on a whole part formed by overlapping between the scanning electrode 31 and the data electrode 16. Accordingly, the write condition does not become uniform to make a flicker, or to generate write inferiority on the entire panel in an extreme case only to perform impractical display. High electricity consumption also becomes obvious.

SUMMARY OF THE INVENTION

In view of the foregoing, an object of the present invention is to provide an AC-PDP which realizes an emission display having high brightness and reduction of power dissipation by improving an emission efficiency.

Another object is to provide an AC-PDP in which a write operation can be securely conducted in a short period of time and has low power dissipation by devising a data electrode shape.

The present invention provides, in a first aspect thereof, an AC plasma display panel including: first and second glass substrates; a plurality of partition walls sandwiched between said first glass substrate and said second glass substrate, said partition walls extending in a column direction to separate a plurality of discharge cells in a row direction; a pair of transparent electrodes for extending in said row direction parallel to each other with a discharge gap therebetween in each of said discharge cells to operate surface discharge (in-plane discharge) therebetween; a plurality of metallic bus electrodes each disposed on said first glass substrate corresponding to each of said transparent electrodes, each of said transparent electrodes including a discharge part and a coupling part in each of said discharge cells, said coupling part coupling said discharge part to one of said metallic bus electrodes and coupling two of said discharge part disposed in adjacent two of said discharge cells; and a data electrode disposed on said second glass substrate to extend in each of said discharge cells in said column direction, said data electrode and said discharge part of a corresponding one of said transparent electrodes operating preliminary discharge therebetween.

The present invention provides, in a second aspect thereof, an AC plasma display panel including: first and second glass substrates; a plurality of partition walls sandwiched between said first glass substrate and said second glass substrate, said partition walls extending in a column direction to separate a plurality of discharge cells in a row direction; a pair of transparent electrodes for extending in said row direction parallel to each other with a discharge gap therebetween in each of said discharge cells to operate surface discharge therebetween; and a data electrode disposed on said second glass substrate to extend in each of said discharge cells in said column direction, said data electrode having a first width adjacent to said discharge gap and a second width adjacent to a side of said transparent electrode opposite to said discharge gap, said first width being larger than said second width.

In accordance with the electrode structure of the first aspect of the present invention, since the discharge part of the transparent electrode is separated from the bus electrode and the partition wall, a high emission efficiency can be obtained. Although the display discharging electrode is isolated in the discharge cell, the entire transparent electrode may have a connected structure and can be electrically connected with the bus electrode by way of a plurality of the coupling parts, and a dark defect liable to be generated in an isolated electrode structure is hardly generated.

In accordance with the electrode structure of the second aspect of the present invention, since the counter discharge for writing always occurs near the surface discharging gap of the scanning electrode by employing the data electrode having a specified shape, a high resolution panel with full-color display which requires higher-speed writing can be realized. An electrostatic capacity of the data electrode can be reduced while improving the write performance in the data electrode structure of the second aspect, and reduction of electricity consumption which may be a serious problem in a high resolution large picture panel can be realized.

The above and other objects, features and advantages of the present invention will be more apparent from the following description.

PREFERRED EMBODIMENTS OF THE INVENTION

Figure 1A:
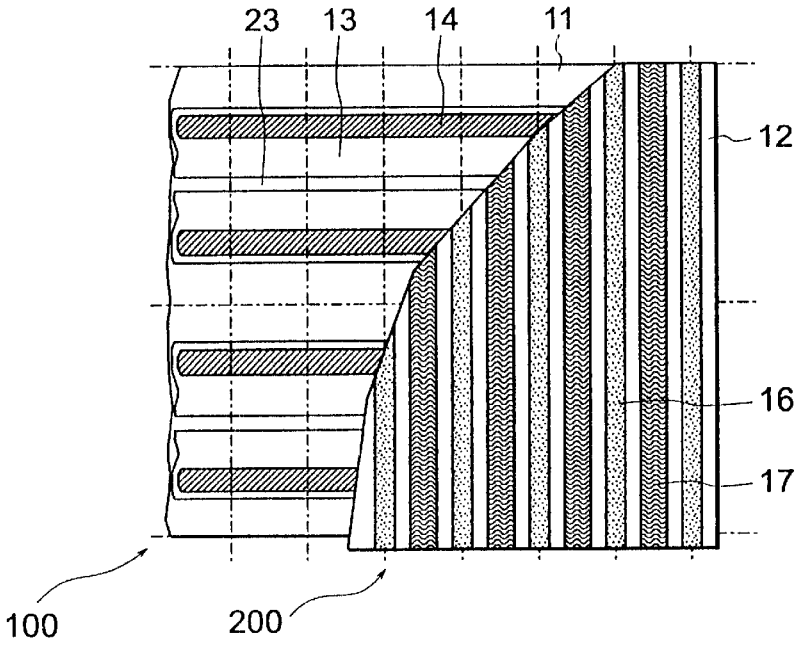
FIG. 1A PRIOR ART
FIG. 1A is a side elevational view of a conventional AC-PDP excluding part of a rear substrate.
Figure 1B:
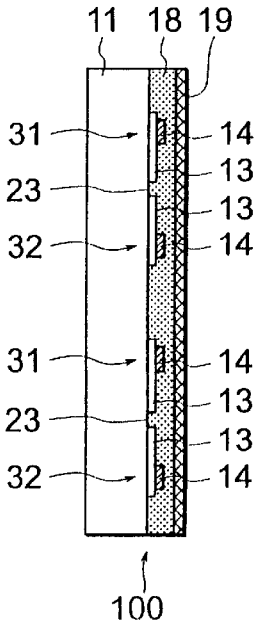
FIG. 1B PRIOR ART
FIG. 1B is a side sectional view of the front substrate shown in FIG. 1A
Figure 1C:
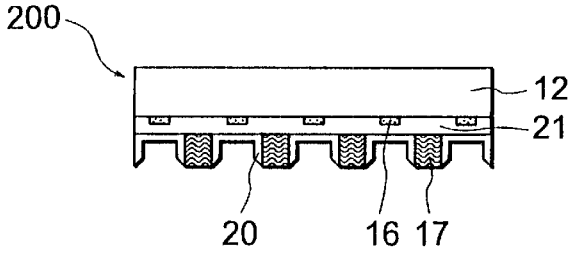
FIG. 1C PRIOR ART
FIG. 1C is a horizontal sectional view of the rear substrate shown in FIG. 1A.
Figure 2:
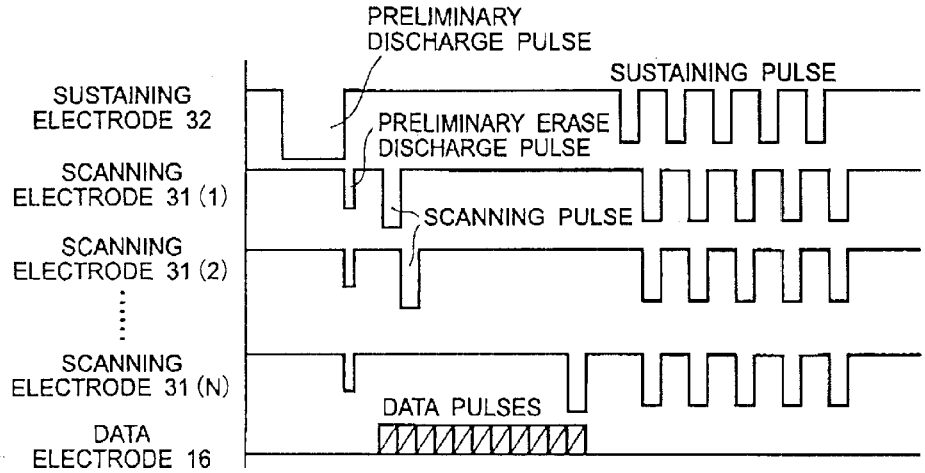
FIG. 2 PRIOR ART
FIG. 2 is a timing chart of driving pulses for driving electrodes of FIGS. 1A to 1C.

Now, the present invention is more specifically described with reference to accompanying drawings The description of the same elements as those of the conventional example shown in FIGS. 1 and 2 will be omitted by affixing the same numerals thereto.

Embodiment 1

Figure 5:
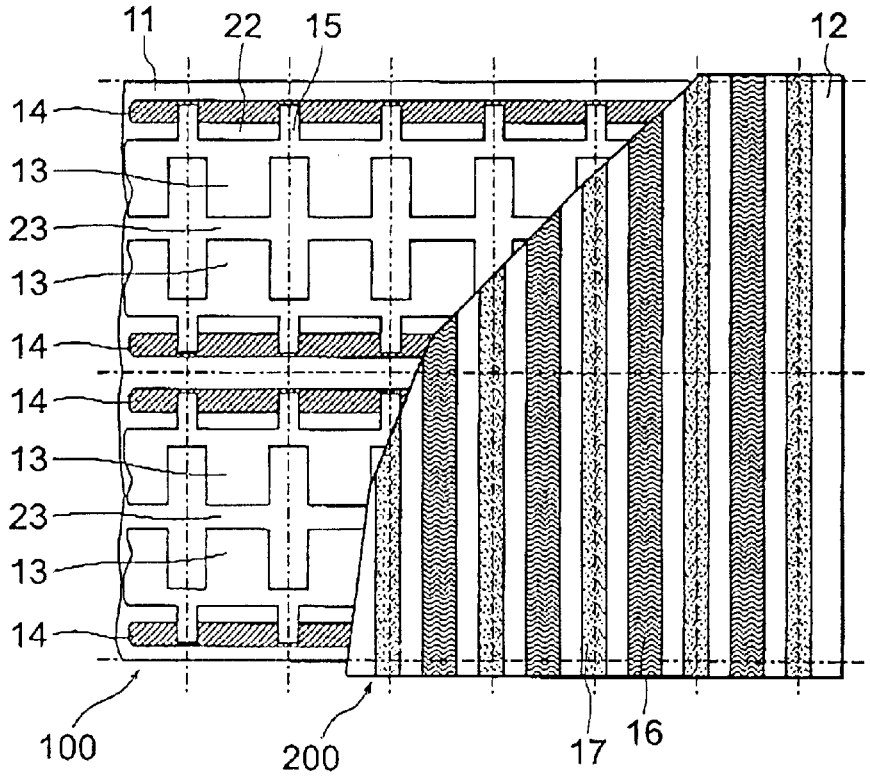
FIG. 5 is a side elevational view excluding a part of a rear substrate of an AC plasma display panel in accordance with Embodiment 1 of the present invention.

As shown in FIG. 5, an AC-PDP includes a pair of glass substrates 11 and 12, transparent electrodes 13, bus electrodes 14, coupling parts 15, data electrodes 16 and partition walls 17. The AC-PDP is fabricated as follows.

An ITO (indium-tin oxide) film is formed by sputtering on the glass substrate 11 functioning as a front surface substrate 110, and the transparent electrode 13 having comb-like projections as shown in FIG. 5 is formed by means of a photo-lithographic technique. The bus electrode 14 is formed to extend parallel to the transparent electrode 13 at the side of the transparent electrode 13 opposite to a surface discharging gap 23. A space 22 is formed between the transparent electrode 13 and the bus electrode 14. A plurality of the coupling parts 15 of the transparent electrode 13 projecting towards the bus electrode 14 are formed at a constant pitch on the transparent electrode 13, and the transparent electrode 13 and the bus electrode 14 are electrically connected to each other by the coupling part 15. The transparent electrode 13 and the bus electrode 14 form a pair, between which the discharge gap 23 is interposed. Two pairs of the transparent electrode 13 and the bus electrode 14 are shown in FIG. 5, and the first pair functions as a scanning electrode 31 and the other functions as a maintaining electrode 32. A transparent dielectric layer is formed on these electrodes and a protection layer made of magnesium oxide is formed on the transparent dielectric layer. In the present embodiment, the pixels are disposed at a 1.2 mm pitch, a width of the bus electrode 14 is 70 micrometers, the space 22 is 60 micrometers and the width of the projection of the transparent electrode 13 is 250 micrometers. The bus electrode 14 extends to outside of the PDP and is connected to a driving circuit.

The rear substrate 200 is basically similar to that described in the conventional example, and mounts thereon stripe data electrodes 16 and partition walls 17 disposed at a pitch of 400 micrometers. Fluorescent substances 20 of red, green and blue are applied on the surface of the rear substrate 200. After a front substrate 100 and the rear substrate 200 are aligned to position the coupling parts 15 beneath the partition walls 17, the PDP is assembled and completed by means of sealing and enclosure of a discharge gas.

In a sample fabricated according to Embodiment 1, as a result of applying suitable alternate maintaining discharge voltage pulses between the scanning electrode 31 and the maintaining electrode 32, a higher emission efficiency than that of the conventional panel could be obtained by about 10 to 40%. The maintaining discharge occurred by employing the transparent electrode 13 as a discharge electrode, and it was observed that no maintaining discharge is generated on the bus electrode. This is because the surface discharge generated between the transparent electrodes does not shift to the bus electrode due to the space 22 under an appropriate voltage for the pulses.

Figure 3:
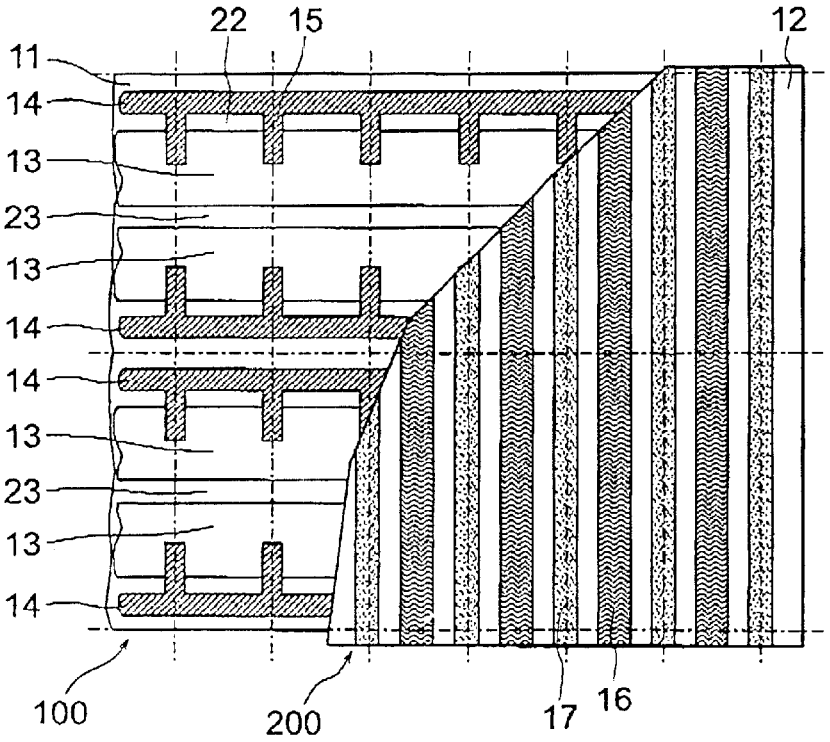
FIG. 3 PRIOR ART
FIG. 3 is a side elevational view of an electrode structure of a conventional AC plasma display panel.

The emission efficiency of the PDP of the type shown in FIG. 3 modified according to Embodiment 1 was also improved by 10 to 30% by means of decrease of the electrode area though the brightness itself reduced. This is because inactivation of the excited particles on the partition wall decreased by a space of 40 micrometers formed between the partition wall 17 having a fluorescent coat and the transparent electrode 13.

The structures of the electrodes of the present invention will be described in detail with reference to FIG. 5 showing a pixel area of the PDP of FIG. 5.

Figure 6:
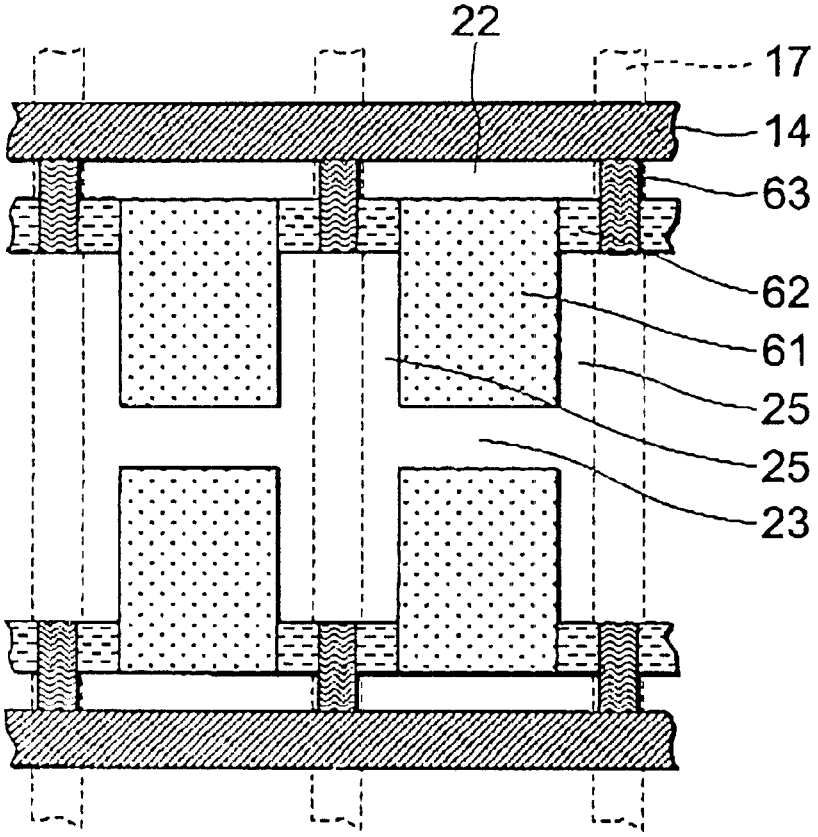
FIG. 6 is a side elevational view of an electrode structure of FIG. 5.

The electrode disposed at the front substrate side includes a discharge part 61, a coupling bar 62, a projection 63 and the bus electrode 14 at each side of the pixel as shown in FIG. 6. The discharge part 61 is an electrode for generating the maintaining discharge which directly contribute to the emission, and is composed of a transparent conductive film. The coupling bar 62 and the projection 63 function as a connection, and has a role of connecting the discharge part 61 to the bus electrode 14 made of a metal film. In order to secure a space 22 between the discharge part 61 and the bus electrode 14, the projection 63 extends to below the partition wall 17 and is connected with the discharge part 61 by way of the coupling bar 62. The discharge part 61 has not only the space 22 between the bus electrode 14 and itself but also a partition wall space 25 between the partition wall 17 and itself. The structure shown in FIG. 6 is formed by patterning the transparent conductive film to make the discharge part 61, the coupling bar 62 and the projection 63, and the bus electrode 14 is formed in the shape of a simple belt by employing a thick film made of silver. The space 22 between the discharge part 61 and the bus electrode 14, and the partition wall space 25 between the discharge part 61 and the partition wall 17 are important for improving the efficiencies, and they are preferably 20 micronmeters or more. The improvement effect of the emission efficiency has a tendency of saturation on 100 micronmeters or more.

Although the transparent electrode 13 has the shape of the display discharging electrode practically separated from the partition wall 17 and the bus electrode 14 as shown in FIG. 5, the inspection regarding electrical shortcut or breakdown of the transparent electrode 13 can be conducted by measuring an electrical resistance between the both ends of the panel of the transparent electrode 13 after the patterning of the transparent electrode 13. A yield of manufacture of the panel is also elevated. Since each discharge part 61 has the coupling parts 15 at the both ends, a point defect is hardly generated even if breakdown of the coupling part 15 having a narrow pattern width occurs because a voltage is applied from the other side.

Since the AC-PDP of Embodiment 1 is constituted as described above, the following effects can be obtained.

Since the discharge part 61 of the transparent electrode 13 of the electrode structure of the AC-PDP is separated from the bus electrode 14 and the partition wall 17, the high emission efficiency can be obtained.

Although the transparent electrode is nearly isolated from the other elements in the discharge cell, the entire transparent electrode can have a connected structure, and is electrically connected with the bus electrodes 14 at a plurality of the coupling parts 15. A dark defect likely generated in an isolated electrode structure is hardly generated. A conductive test can be carried out during a process of patterning the transparent electrode, and the structure is of practical use.

As a result of applying appropriate alternate maintaining discharge voltage pulses for driving between the scanning electrode 31 and the maintaining electrode 32 of the panel, a higher emission efficiency than that of the conventional panel was obtained by 10 to 40%.

Figure 4:
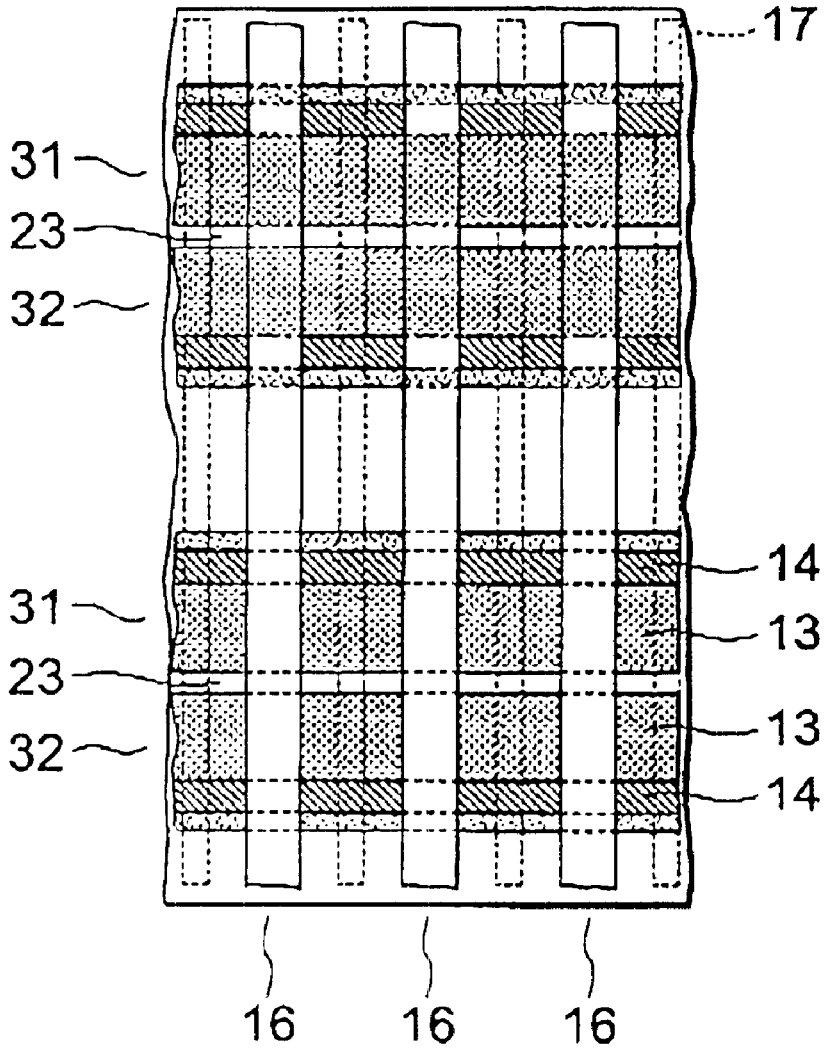
FIG. 4 PRIOR ART
FIG. 4 is a side elevational view showing in detail electrodes of FIG. 1A.

An emission efficiency of the panel shown in FIG. 4 was also improved by 10 to 30% by means of decrease of the electrode area though the brightness itself reduced. This is because inactivation of the excited particles on the partition wall decreased by a space of 40 micronmeters formed between the partition wall 17 on which the fluorescent substance was applied and the transparent electrode 13.

The inspection regarding electrical shortcut or breakdown of the transparent electrode 13 can be conducted by measuring an electrical resistance between the both ends of the panel of the transparent electrode 13 after the patterning of the transparent electrode 13. A yield of manufacture of the panel is also elevated.

Embodiment 2

Figure 7:
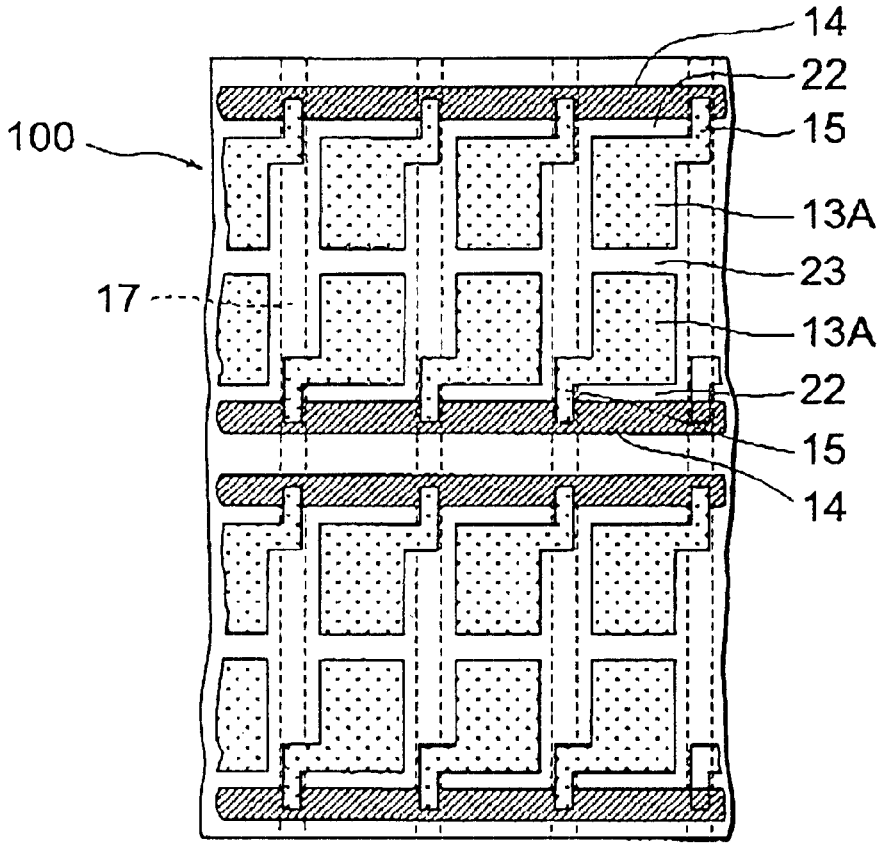
FIG. 7 is a side elevational view of an AC plasma display panel in accordance with Embodiment 2.

As shown in FIG. 7, the AC-PDP of Embodiment 2 has transparent electrodes 13A having an isolated structure. Embodiment 2 corresponds to a case where the coupling bar 62 exists only on one side of the discharge part 61. Although a dark defect may be generated when the electrode pattern has a defect, and shortcut or breakdown of the transparent electrode 13 cannot be electrically inspected because the projection 63 with the bus electrode 14 exists only on one side, an emission efficiency can be further improved because the coupling bar 62 exists only on one side. When an ability of manufacturing the transparent electrode pattern is high, the transparent electrode of FIG. 7 is effectively employed to elevate the emission efficiency.

Since the AC-PDP of Embodiment 2 is constituted as described above, the following effects can be obtained in addition to the effects of Embodiment 1.

Since the coupling bar 62 exists only on one side, the emission efficiency can be further improved.

When the ability of manufacturing the transparent electrode pattern is high, the transparent electrode of FIG. 7 is effectively employed to elevate the emission efficiency.

The position of the coupling bar 62 and materials of the coupling bar 62 and the projection 63 are not restricted to those of Embodiments 1 and 2. Since these part are not necessarily composed of transparent conductive films and have an option, various alternations can be made for practicing the present invention.

Embodiment 3

Figure 8:
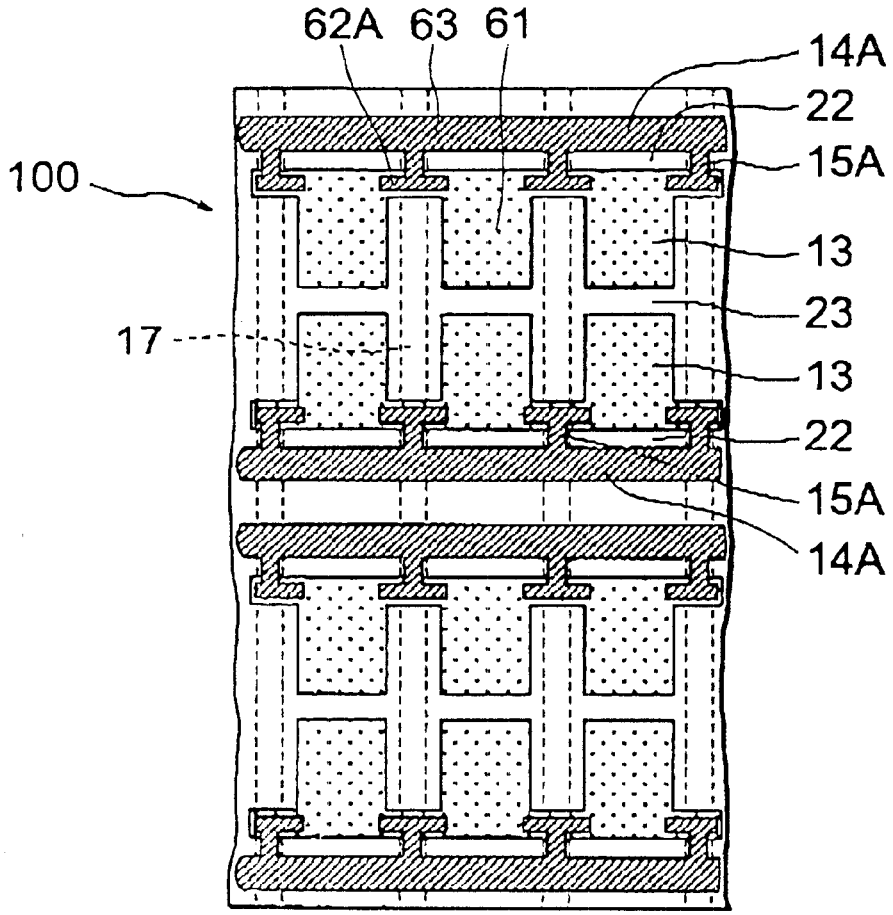
FIG. 8 is a side elevational view of an AC plasma display panel in accordance with Embodiment 3.

In the AC-PDP of Embodiment 3 shown in FIG. 8, the coupling bar 62A and the projection 63 which act as the coupling part 15A are formed as a part of the pattern of the bus electrode 14A. In Embodiment 3, the bus electrode 14A may not extend to the coupling bar 62A, and it may include only the projection 63. The formation of the projection 63 and the coupling bar 62A as a part of the bus electrode 14A is useful when the transparent electrode 13 is a thin film which is liable to be breakdown due to a fine crack.

Embodiments 4 to 6

Figure 9:
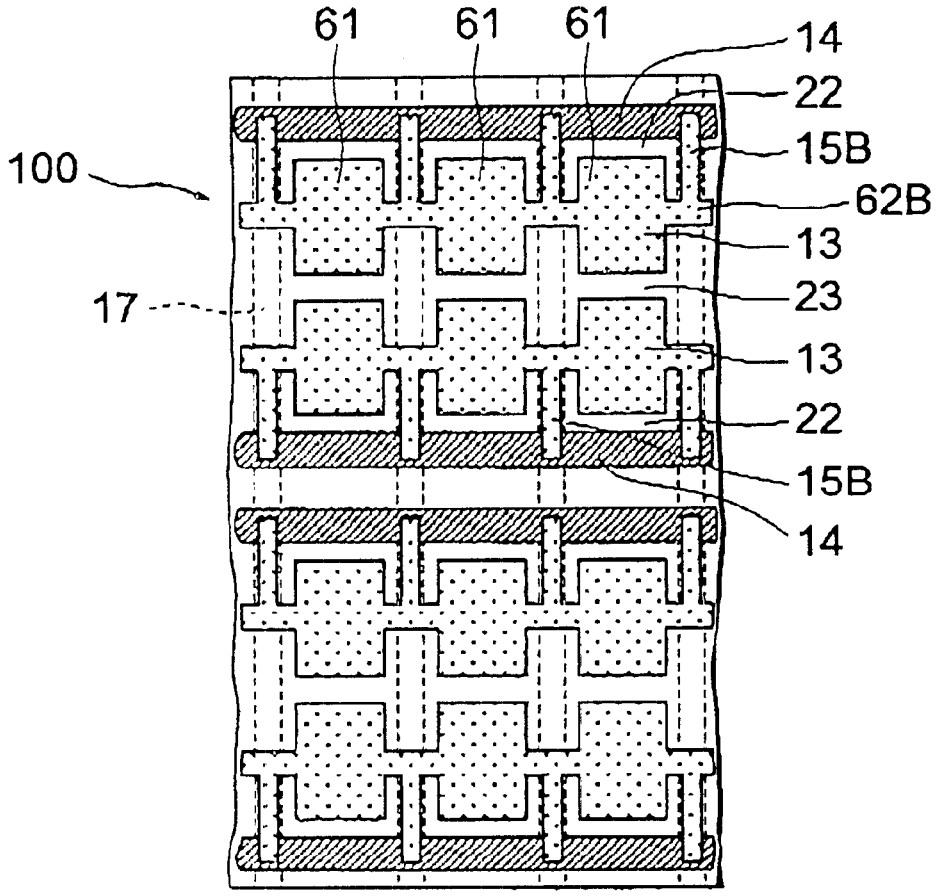
FIG. 9 is a side elevational view of an AC plasma display panel in accordance with Embodiment 4.
Figure 10:
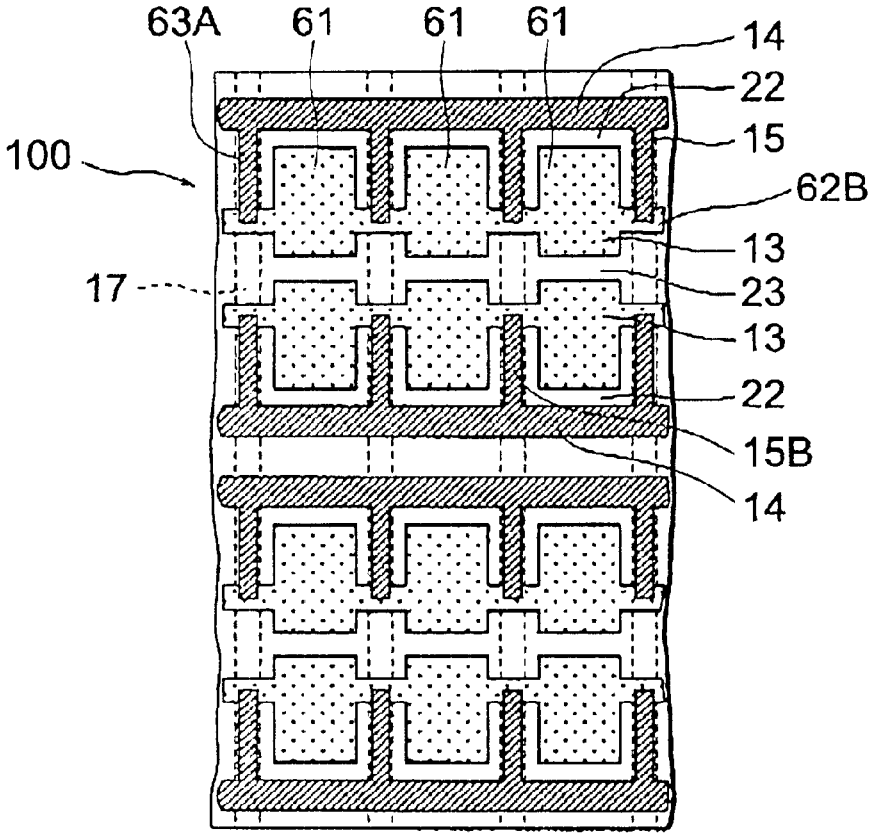
FIG. 10 is a side elevational view of an AC plasma display panel in accordance with Embodiment 5.

Embodiment 4 of the present invention is shown in FIG. 9 in which the coupling bar 62B is formed at the middle of the discharge part 61.

Figure 11:
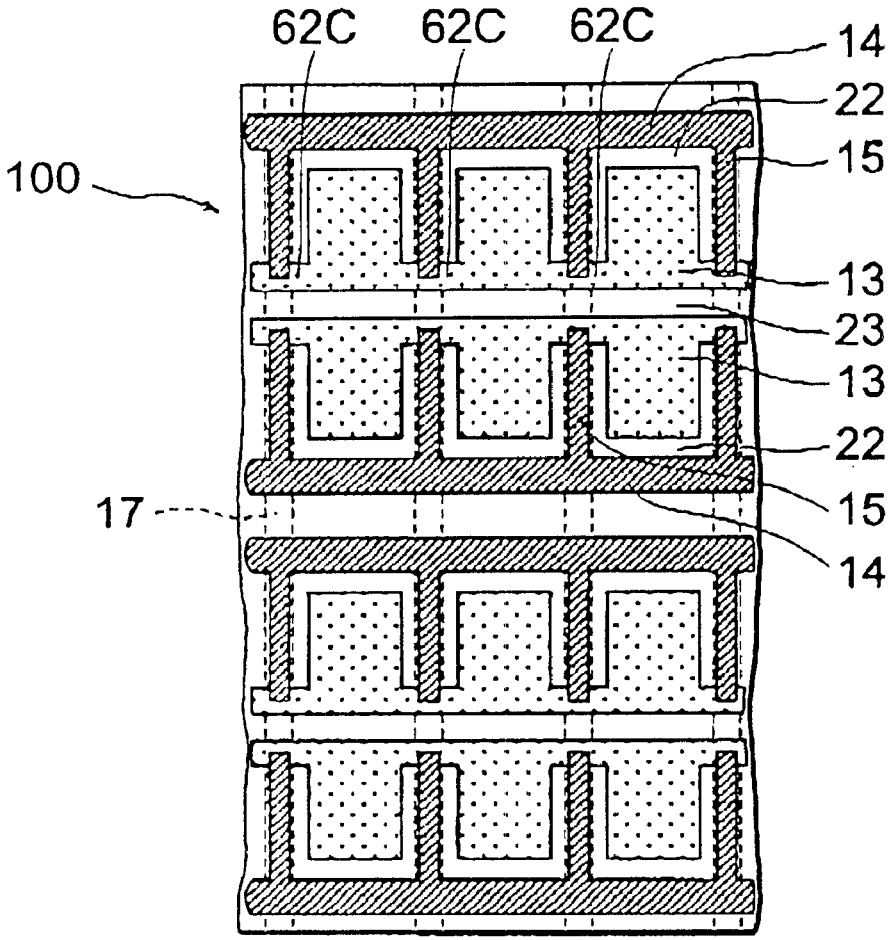
FIG. 11 is a side elevational view of an AC plasma display panel in accordance with Embodiment 6.

Embodiment 5 of the present invention is shown in FIG. 11 in which the coupling bar 62B is formed at the middle of the discharge part 61 and the projection 63A under the partition wall extends from the bus electrode 14.

Embodiment 6 of the present invention is shown in FIG. 11 in which the coupling bar 62C is formed at the position of the surface discharging gap 23.

Any one of the shapes illustrated in Embodiments can be selected depending on cell design, a process of manufacture and a sheet resistance of a transparent conductive film. Under the present circumstance, the structure of Embodiment 1 is excellent in its ease of patterning, loose requirement of an aligning accuracy between the transparent electrode 13 and the bus electrode 14, and a small electrostatic capacity of the scanning electrode 31 and the maintaining electrode 32 based on evaluation of trial pieces.

It is important in Embodiments that the maintaining discharge is not generated on the bus electrode but on the transparent electrode 13 and mainly on the discharge part 61. When the maintaining discharge voltage is maintained high, the discharge reaches to the bus electrode 14. When the discharge reaches to the bus electrode 14, the emission efficiency is lowered though the emission brightness is increased. When a cell in which the emission occurs only on the transparent electrode 13 in the panel and a cell in which the emission reaches to the transparent electrode 13 coexist, display quality is remarkably deteriorated because emission strengths of the cells are different from one another.

A wider maintaining voltage range which stably maintains the discharge at the discharge part 61 of the transparent electrode 13 can be obtained when a wider space 22 is formed because the discharge onto the bus electrode 14 hardly occurs. However, the wider space 22 makes the area of the discharge part 61 smaller to decrease the brightness, and accordingly the width of the space 22 is required to be well-balanced. The formation of the thicker dielectric layer on the bus electrode 14 or of the dielectric layer having a low dielectric constant and the addition of a step of reducing a secondary electron emission rate on the upper surface of the bus electrode make the discharge hardly reach to the bus electrode 14. In this case, a wider maintaining discharge voltage range can be obtained.

Since the AC-PDP of Embodiments 3 to 6 is constituted as described above, the following effects other than those produced in Embodiments 1 and 2 can be obtained.

The transparent electrode 13 which is a thin film is difficult to be breakdown due to a fine crack by forming the projection 63 and the coupling bar 62 as the part of the bus electrode 14.

The emission strengths of the respective cells are made to be equal with one another to maintain the display quality high by generating the maintaining discharge not on the bus electrode 14 but on the transparent electrode 13 especially on its discharge part 61.

Embodiment 7

Figure 12:
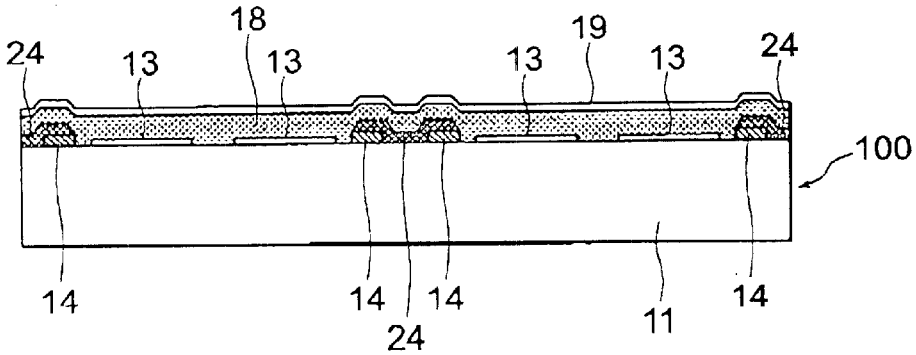
FIG. 12 is a cross sectional view of an AC plasma display panel in accordance with Embodiment 7.

The AC-PDP of Embodiment 7 has a structure shown in FIG. 12 which illustrates a cross section of the front substrate 100 prepared by adding a black layer 24 to the panel having the electrode structure of Embodiment 1 in which dark contrast is improved by blackening surfaces between the bus electrodes 14 to reduce a reflectivity of an outer ray of the panel. The transparent electrode 13 and the bus electrode 14 are formed on the glass substrate 11. The bus electrode 14 is formed separated from the transparent electrode 13 functioning as the discharge part 61 at the opposite side of the surface discharging gap 23. A bus electrode of an adjacent cell extends in parallel maintaining a space. The rear substrate is the same as that of Embodiment 1.

The black layer 24 covers the upper parts of two bus electrodes 14 adjacent to each other in FIG. 12. The black layer 24 is formed by means of screen printing of a paste of which a main component is inorganic pigment powders such as a transition metal oxide and a low softening point glass powders or by means of photo-lithographically treating a photosensitive paste. The black layer 24 is not only formed between the bus electrodes 14 but also covers the entire bus electrode 14. The black layer may be a part of the bus electrode. The bus electrode may have a two-layered structure one of which is the black layer at the display side. When the surface between the adjacent bus electrodes are blackened, the effects of improving the contrast are nearly the same. The formation of the black layer is determined by considering a margin of a step of aligning.

Although the black layer 24 is formed immediately after the formation of the bus electrode in FIG. 12, the black layer can be formed on the upper part of the dielectric layer 18 or in the dielectric layer 18 or on the upper part of the protection film 19, and according to circumstances, the black layer can be directly formed on the glass substrate 11 before the formation of the bus electrode 14.

The shape and the position of the black layer 24 are rather arbitrary in connection with the improvement of the contrast. Advantageously, the discharge on the bus electrode is difficult to occur because the electrostatic capacity of the entire dielectric layer on the bus electrode is decreased as a result of forming the black layer 24 which covers also the top part of the bus electrode 14. Accordingly, the material of the black layer 24 preferably has a dielectric constant as low as possible. The covering of the entire bus electrode with the black layer effectively reduces the electrostatic capacity of the bus electrode adjacent thereto. Most preferably, the two adjacent bus electrodes 24 are directly covered with the black layer 24 having a small dielectric constant as shown in FIG. 12.

Embodiment 8

Figure 13:
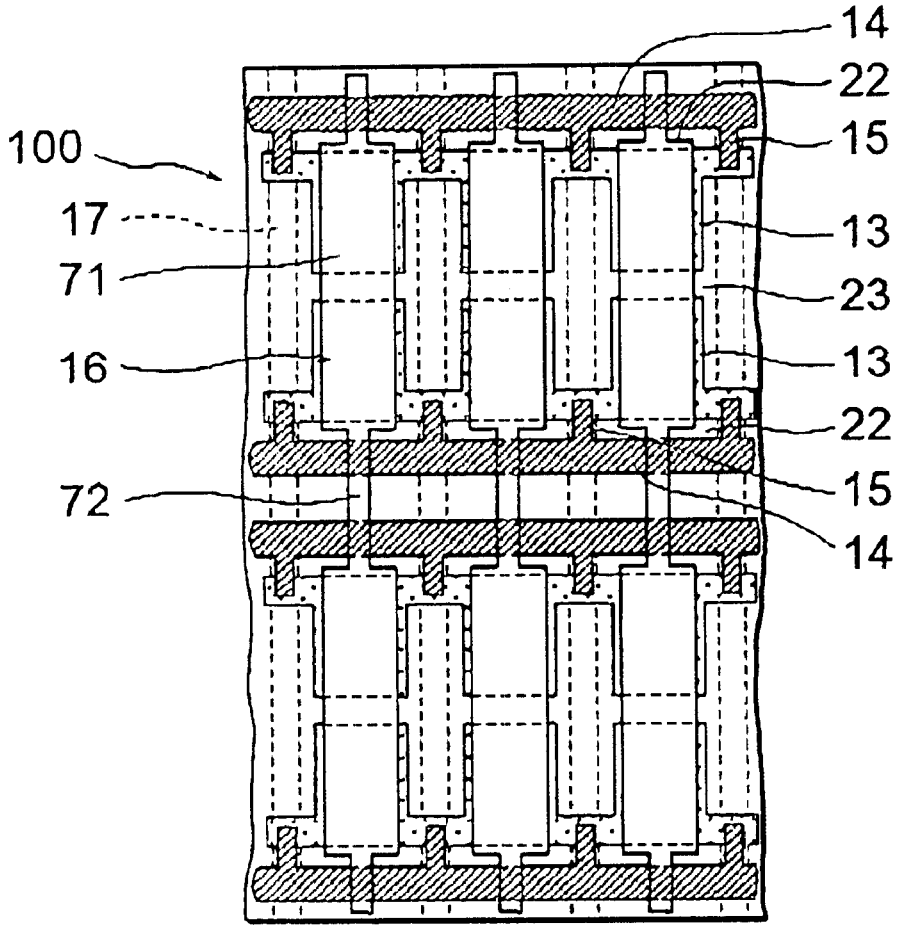
FIG. 13 is a side elevational view of an AC plasma display panel in accordance with Embodiment 8.

A panel structure of Embodiment 8 will be described which has been manufactured by improving the data electrode structure. Although the panel structure of Embodiment 8 is basically the same as that of Embodiment 1, only the shape of a data electrode is different from that of Embodiment 1. The relation in connection with positioning among the bus electrode 14, the transparent electrode 13 and the data electrode 16 are shown in FIG. 13 for easier understanding. Although a conventional data electrode is a stripe electrode having the same width along its length, the data electrode 16 of Embodiment 8 has a widened part 71 near the transparent electrode 13 and a narrowed part 72 near the bus electrode. For example, the widened part is 150 micronmeters wide and the narrowed part is 50 micronmeters wide.

When the panel having the uniform data electrode width was driven, instability in a write operation was observed. The write operation is completed by initially generating a counter discharge between the data electrode 16 and the scanning electrode 31, generating a discharge between the maintaining electrode 32 and the scanning electrode 31 employing the counter discharge as a trigger, and forming wall charges including a positive charge and a negative charge on the scanning electrode 31 and the maintaining electrode 32.

When the counter discharge was securely generated between the transparent electrode 13 and the data electrode 16, the stable write operation could be conducted. When, on the other hand, the counter discharge occurred between the bus electrode 14 and the data electrode or it occurred between the bus electrodes 14 and then extended to between the transparent electrode 13 and the data electrode 16, display inferiority such as a flicker was generated. When priming was generated on the bus electrode, excellent display could not be obtained because an erased state after the priming was badly influenced thereby.

Although, as described earlier, the measures of forming the black layer 24 on the bus electrode to prevent the shifting of the surface discharge which is maintaining discharge to the bus electrode 14 by means of reducing the electrostatic capacity of the dielectric layer on the bus electrode have an effect of averting the counter discharge of the writing on the bus electrode, the measures are insufficient for the excellent write stability and require an additional step of covering the dielectric layer.

By narrowing the width of the data electrode on the bus electrode, the counter discharge around this portion at the time of writing was made to hardly occur because the voltage for generating the discharge was influenced by the electrode surface area. By always performing the write operation between the wide data electrodes, stable display could be realized.

Although the width of the narrowed part 72 of the data electrode is preferably narrower as much as possible, the extreme narrowness cannot be obtained because of its limitation for manufacture. The width of 100 micrometers or more does not exhibit an ordinary effect, and the width of 80 micronmeters or less is desirable.

Figure 14:
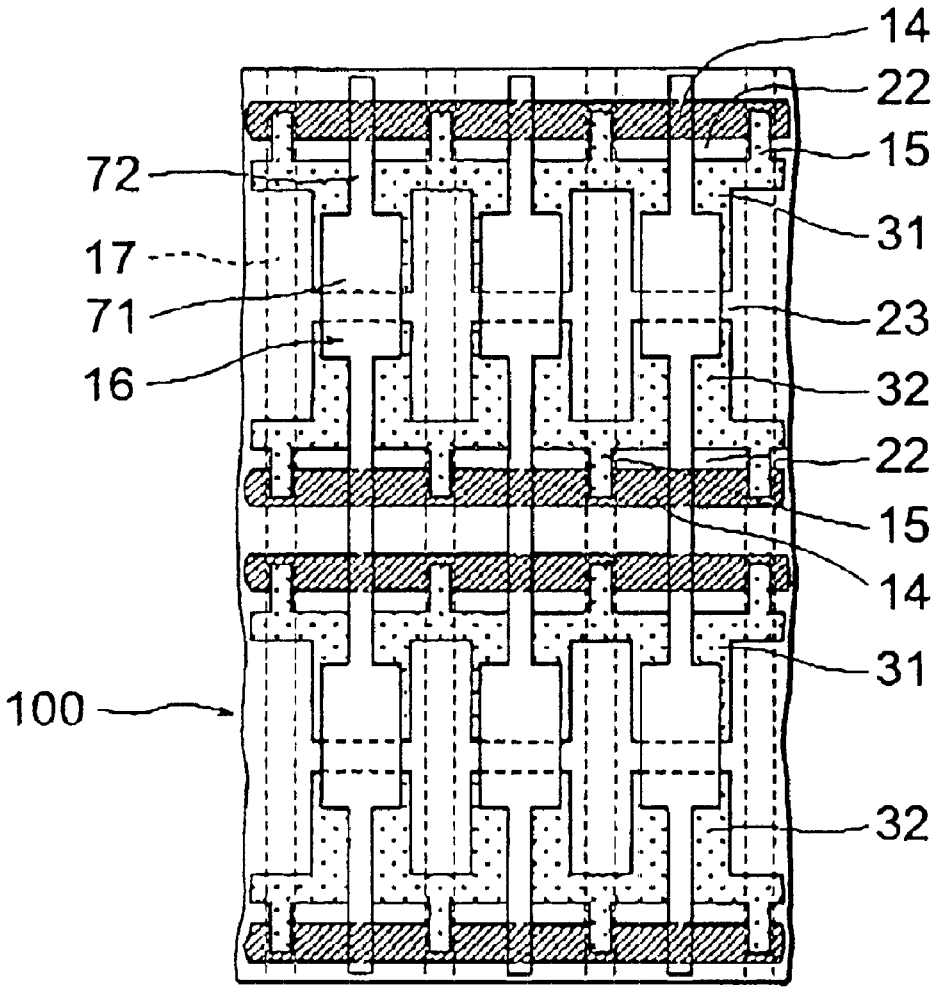
FIG. 14 is a side elevational view of another AC plasma display panel in accordance with Embodiment 8.

As a result of further examining the width of the data electrode, a more stable write operation could be obtained when the data electrode 16 near a side edge portion of the surface discharging gap of the transparent electrode 13 acting as the scanning electrode 31 had the widened part 71 and the data electrode other than the widened part was formed as a thin element as shown in FIG. 14. This is probably due to the fact that the write discharge occurs near the side edge portion of the surface discharging gap. Since such a data electrode shape can reduce an electrostatic capacity of the data electrode 16, data electricity can be reduced.

Since the AC-PDP of Embodiment 8 is constituted as described above, the following effects other than those produced in Embodiments 1 to 7 can be obtained.

Advantageously, the discharge on the bus electrode hardly occurs because the electrostatic capacity of the entire dielectric layer on the bus electrode is reduced by forming the black layer 24 which also covers the upper part of the bus electrode.

Figure 15:
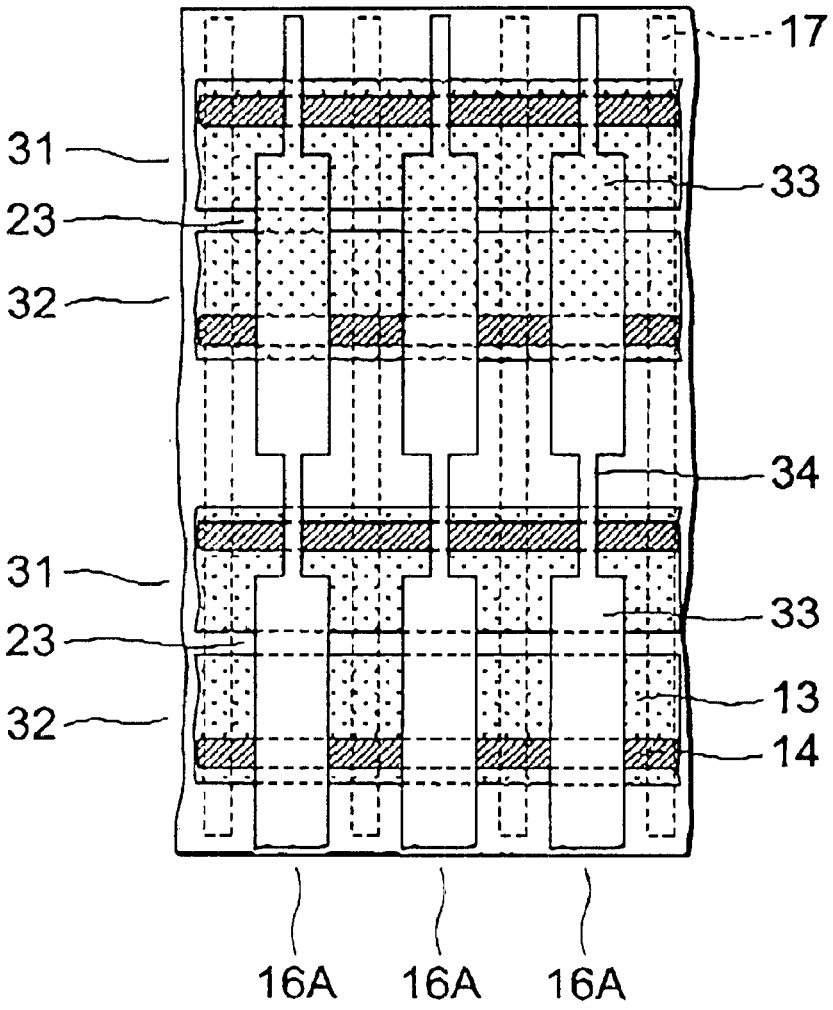
FIG. 15 is a side elevational view of an AC plasma display panel in accordance with Embodiment 9.

As shown in FIG. 15, an AC-PDP of Embodiment 9 has a data electrode shape similar to that of FIG. 14. The AC-PDP includes the transparent electrode 13, the bus electrode 14, a data electrode 16A, the partition wall 17, the surface discharging gap 23, the scanning electrode 31 and the maintaining electrode 32.

As shown in FIG. 15, the data electrode 16A does not have a uniform stripe width but has a large width part 33 and a narrow width part 34. After the large width part 33 is placed generally above the scanning electrode 31 and the maintaining electrode 32 including the surface discharging gap therebetween and the narrow width part 34 is placed above the end part of the scanning electrode 31 including the bus electrode 14 and above a space adjacent to the scanning electrode 31, the front substrate 100 and the rear substrate 200 are aligned and combined.

The counter write discharge always occurs near the surface discharging gap 23 side of the scanning electrode 31 in the SCPDP of Embodiment 9, and the strength of the surface discharge generated by employing the counter discharge as a trigger becomes stable to realize excellent display having few flickers.

Although the improving effects of the write performance is elevated with increase of the width of the large width part 33 and with decrease of the width of the narrow width part 34 of the data electrode 16 in the AC-PDP of Embodiment 9, interference between the adjacent cells may occur to make write errors when the large width part becomes excessively wide. Breakdown may occur to lower a yield when the narrow width part becomes excessively narrow, and accordingly an appropriate value of the width is selected.

In Embodiment 9, preferably a pixel pitch is 1.2mm, and a data electrode pitch is 400 micronmeters. In this case, an excellent write improved effect could be obtained when the width of the large width part 33 of the data electrode 16 was 150 micronmeters and the width of the narrow width part 34 was 50 micronmeters. An apparent effect was obtained when a ratio between the widths of the large width part 33 and the narrow width part 34 was 1.5 or more.

When the width of the narrow width part 34 increases beyond a specified value, considerable decrease of the effects can be observed. The width is preferably about half of the height of the partition wall or less, and is approximately 80 micronmeters or less.

The panel structure of Embodiment 9 has a characteristic in the shape of the data electrode 16 and can be manufactured in accordance with the following steps.

An ITO thin film is formed on the glass substrate 11 acting as the front substrate 100 by sputtering, and the transparent electrode 13 is photo-lithographically formed. Then, the bus electrode 14 is formed along the transparent electrode 13 by means of applying and developing photosensitive silver paste. After the dielectric layer having a thickness of 25 micronmeters is formed by applying low melting point glass paste thereon followed by screen-printing, drying and sintering, a magnesium oxide protection film is formed by vacuum vapor deposition. Photosensitive silver paste is applied on the glass substrate 12 acting as the rear substrate 200 to make the data electrode 16 by means of exposure and developing. After the dielectric layer is formed by applying low melting point glass paste containing a white filler followed by drying and sintering, the partition wall 17 is formed by employing sandblast. The rear substrate 200 is completed by sequentially applying fluorescent substances of red, green and blue followed by sintering. After the rear substrate 200 and the front substrate 100 are combined and sealed, the substrates are heated and the inner gas is exhausted. The panel is completed by finally introducing a mixed gas including neon and xenon into the panel.

In Embodiment 9, the data electrode 16A has the large width part 33 and the narrow width part 34 for elevating the write performance, and the width of the large width part 33 is preferably wider as much as possible and the width of the narrow width part 34 is preferably narrower as much as possible in a range permitted for improving the write performance. However, the most appropriate lengths of the large width part 33 and the narrow width part 34 are preferably selected. If the lengths thereof are too short, the effect of securely generating the counter discharge around the surface discharging gap 23 of the scanning electrode 31 is lowered. The preferable shortest length is influenced by the entire structure of the discharge cell, a kind of the discharge gas and a gas pressure. An opposing gap length approximately determined by a height of the partition wall or the like is a measure. In the ordinary panel, the lengths of the large width part 33 and the narrow width part 34 are desirably 100 micronmeters or more.

Since the AC-PDP of Embodiment 9 is constituted as described above, the following effects can be obtained.

Since the counter discharge always occurs near the side end of the surface discharging gap 23 of the scanning electrode 31 by employing the data electrode 16 having the shape as described above, the write state having excellent reproducibility can be obtained to remove a flicker which is write inferiority, and full-color display of the high resolution panel requiring high speed writing can be realized.

Embodiment 10

Figure 16:
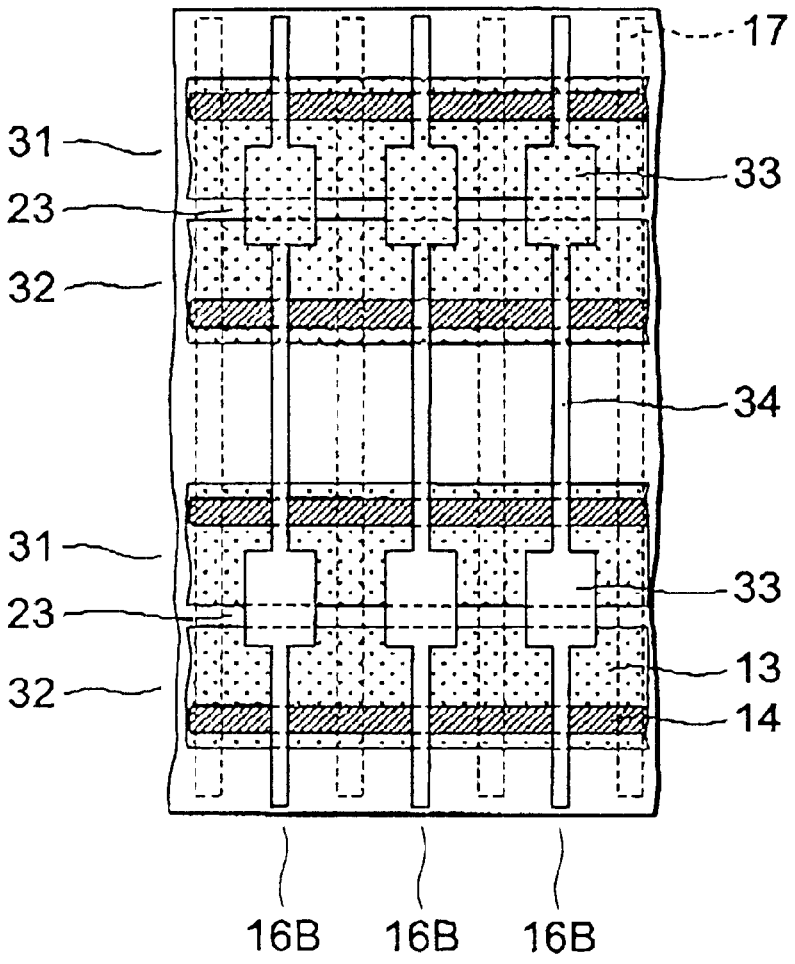
FIG. 16 is a side elevational view of an AC plasma display panel in accordance with Embodiment 10.

Data electrodes 16B shown in FIG. 16 have the large width part 33 around the surface discharging gap 23 of the scanning electrode 31, and have the narrow width part 34 other than the large width part, 33, or the narrow width part 34 is formed all along the data electrode 16B except the position around the surface discharging gap 23 of the scanning electrode 31 which is important for elevating the write characteristics.

Since the AC-PDP of Embodiment 10 is constituted as described above, the following effects can be obtained in addition to those of Embodiment 9.

The data electrode shape of Embodiment 10 reduces an electrostatic capacity between adjacent cells to decrease electricity consumption accompanied with application of data pulses. A most part of electric power used for the data electrode is consumed for charging and discharging thereof and is proportional to the electrostatic capacity. Employment of the data electrode having the shape shown in FIG. 16 can reduce the above electric power by half.

Embodiment 11

Figure 17:
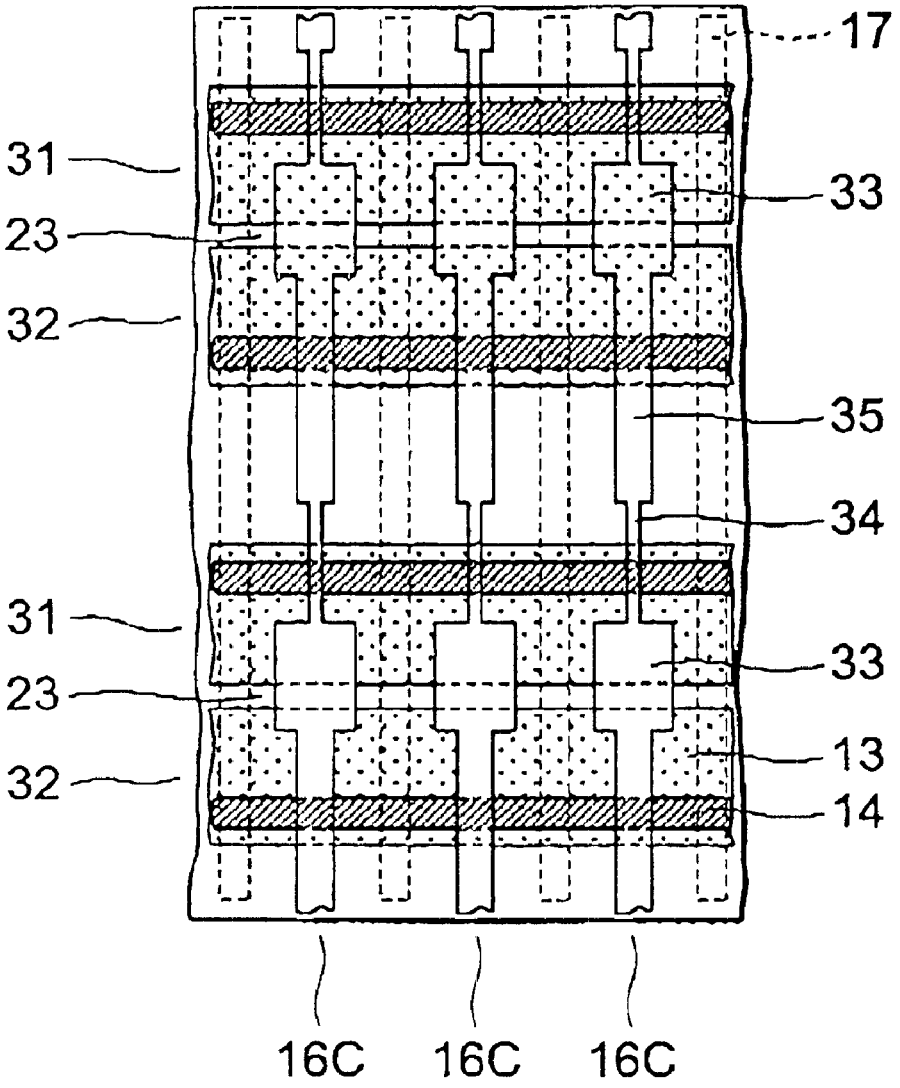
FIG. 17 is a side elevational view of an AC plasma display panel in accordance with Embodiment 11.

The data electrode 16C shown in FIG. 17 has a medium width part 35 between the large width part 33 and the narrow width part 34 for reducing the disadvantage such as breakdown of the data electrode 16C generated by making the narrow width part 34 longer. The medium width part 35 shown in FIG. 17 is formed from the lower end of the large width part 33 existing on the maintaining electrode 32 to the upper end of the narrow width part 34 existing in a space between the maintaining electrode 32 and the scanning electrode 31. The medium width part 35 prevents the lowering of a yield due to the breakdown. Although the medium width part 35 somewhat reduces the effect of decreasing the electricity consumption, the panel having the yield and the electricity consumption-reducing effect well-balanced with each other can be realized.

Since the AC-PDP of Embodiment 11 is constituted as described above, the effect of elevating the yield of manufacturing the panels is obtained in addition to the effects of Embodiments 9 and 10.

Embodiment 12

The present invention is also effective for electrodes other than the ordinary stripe surface discharging electrodes as shown in FIGS. 15 to 17.

Figure 18:
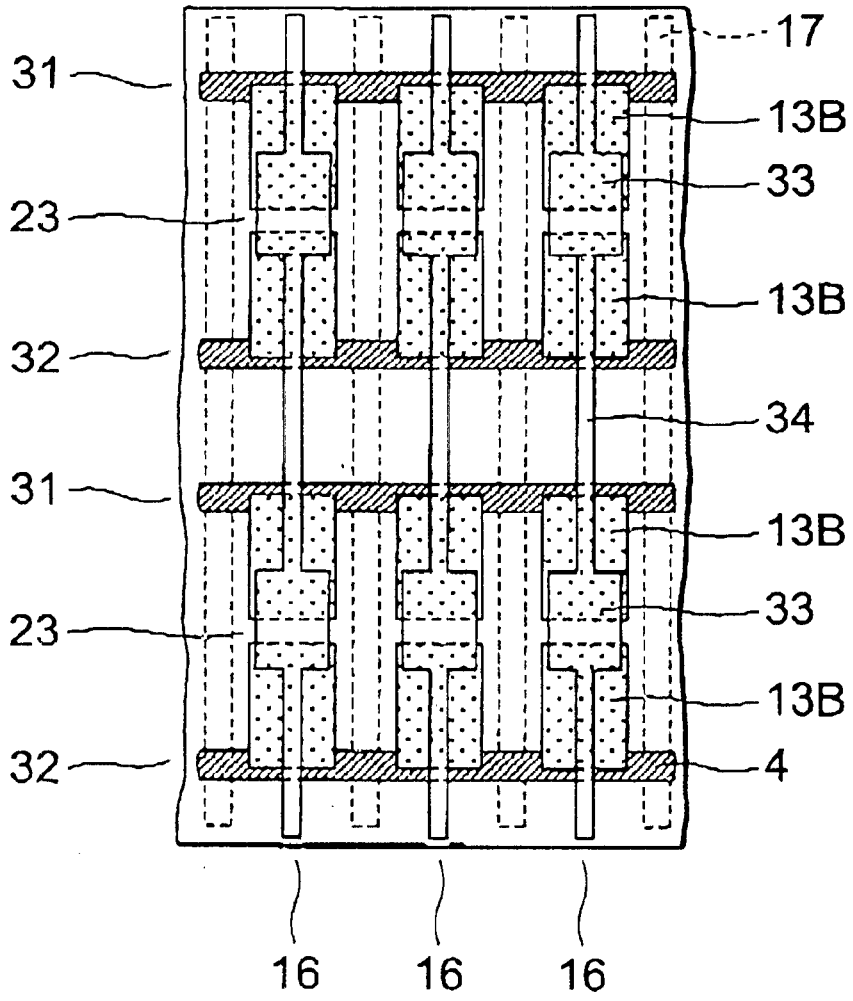
FIG. 18 is a side elevational view of an AC plasma display panel in accordance with Embodiment 12.

The transparent electrode 13B exemplified in FIG. 18 has a separated rectangular shape and is connected to the panel structure by way of the bus electrode 14. The data electrode 16 has the large width part 33 around the surface discharging gap 23 between the separated rectangular transparent electrodes 13B acting as the scanning electrode 31, and the narrow width part 34 other than the large width part 33.

Embodiment 13

Figure 19:
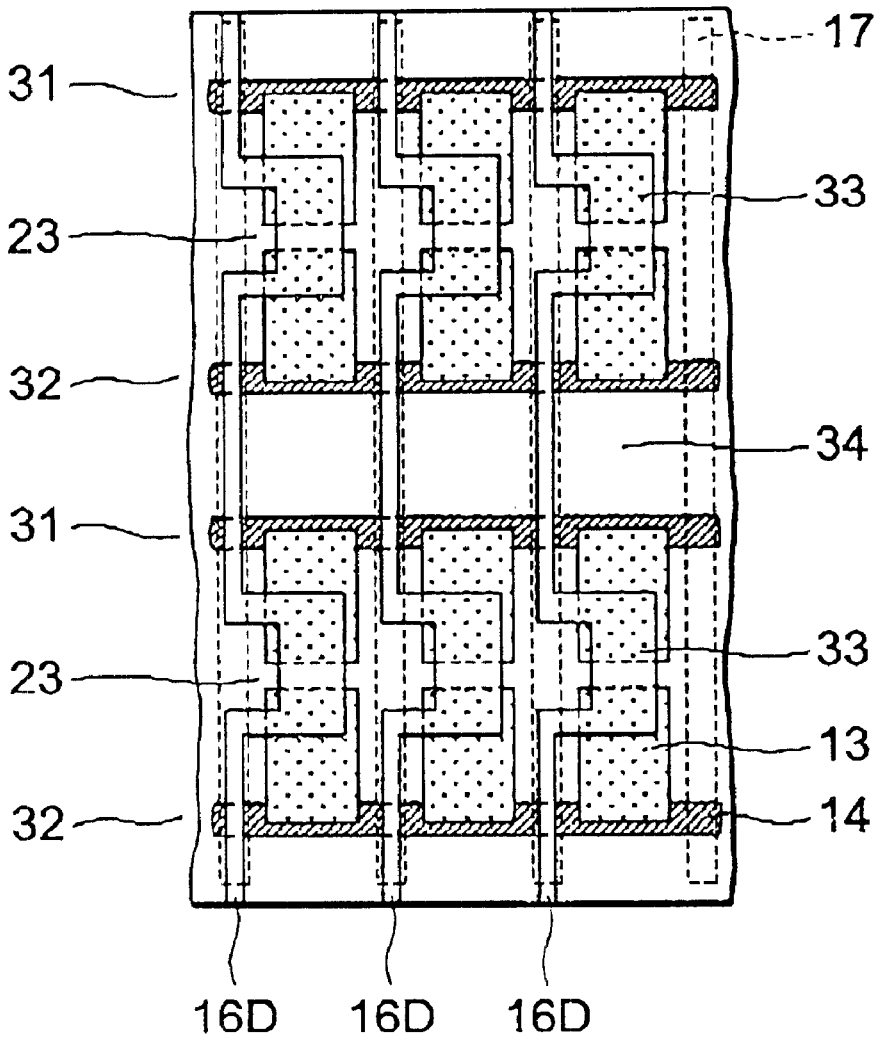
FIG. 19 is a side elevational view of an AC plasma display panel in accordance with Embodiment 13.

The shape of the data electrode is not necessarily a simple shape having a linear center line, and may be a complicated shape having a zigzag center line. As shown in FIG. 19, the narrow width part 34 of the data electrode 16D may be positioned sufficiently overlapped with or along with the partition wall 17. Although accuracy for the patterning and the alignment is required, Embodiment 13 is advantageous for the elevation of the write performance which is an object of the present invention.

Embodiment 14

Figure 20:
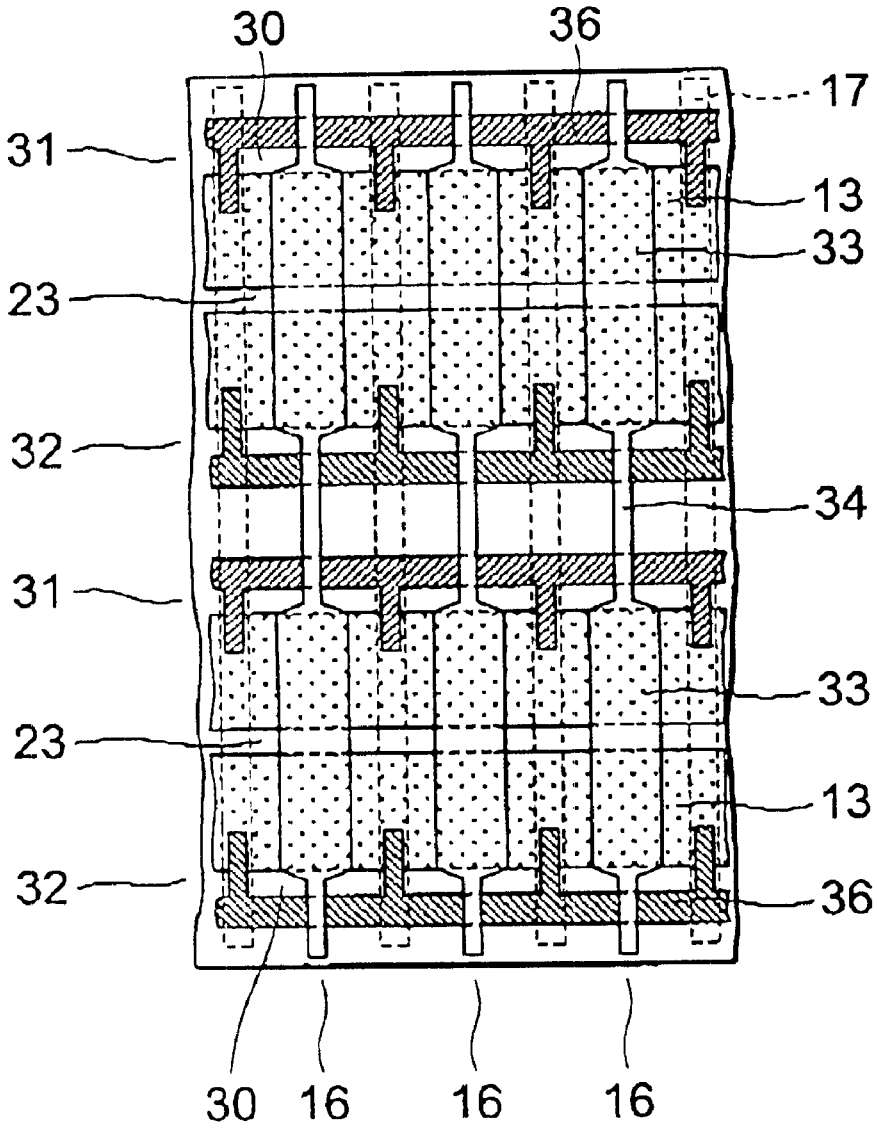
FIG. 20 is a side elevational view of an AC plasma display panel in accordance with Embodiment 14.

In Embodiment 14 shown in FIG. 20, an isolated bus electrode 36 is formed along a space 30 along the other end of which is formed the transparent electrode 13. The transparent electrode 13 and the isolated bus electrode 36 are electrically connected with each other.

The surface discharge generated only on the transparent electrode 13 by employing the isolated bus electrode remarkably improves an efficiency of taking out an emitted beam.

Since the bus electrode 14 is positioned separately from the surface discharging gap 23 in the above electrode structures, an electric filed is weakened not to generate discharge on the bus electrode. Since, however, the write operation is performed by the counter discharge, a large electric filed is generated between the bus electrode and the data electrode 16 by application of scanning pulses and data pulses. Since a film thickness of the bus electrode is thicker than that of the transparent electrode 13, the counter discharge between the bus electrode and the data electrode 16 is generated to weaken the counter discharge between the transparent electrode 13 and the data electrode 16 to insufficiently form a wall charge to make display performance worse.

However, in the present Embodiment, generation of a counter discharge is suppressed to provide an excellent write operation by employing the data electrode 16 in which the large width part 33 is positioned near the upper part of the transparent electrode 13 and the narrow width part 34 is positioned near the upper part of the isolated bus electrode 36.

Embodiment 15

Also in the panel having the isolated bus electrode of Embodiment 14, the important write discharge occurs around the surface discharging gap 23 of the scanning electrode 31.

Figure 21:
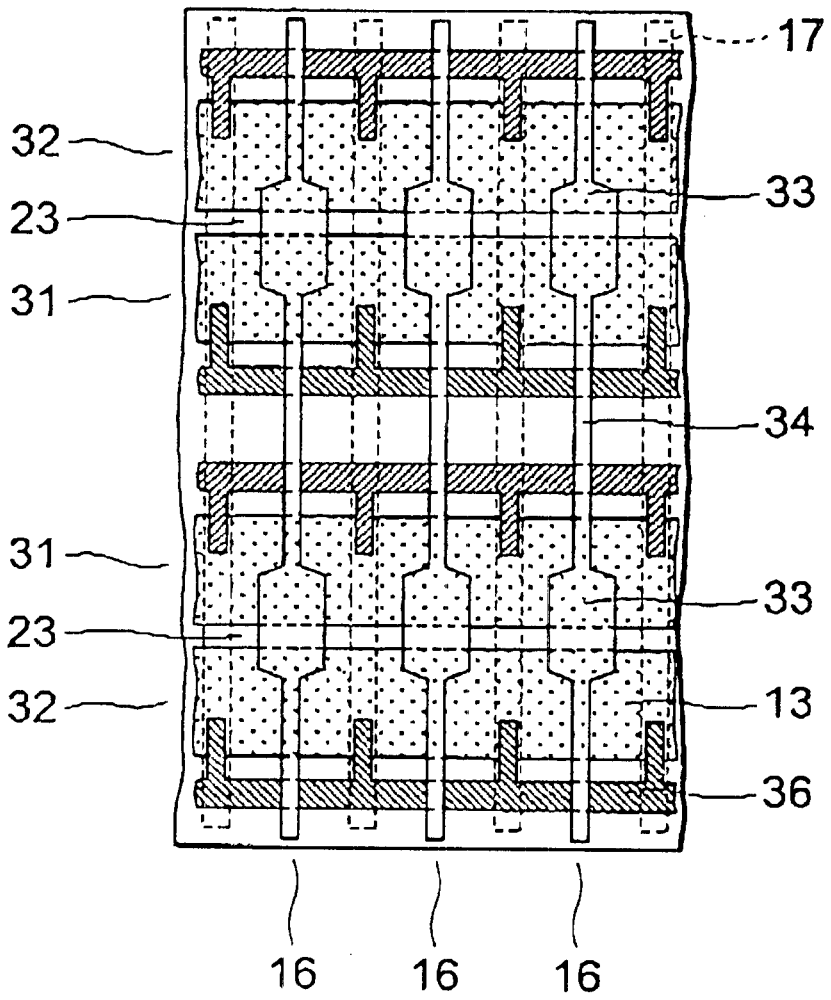
FIG. 21 is a side elevational view of an AC plasma display panel in accordance with Embodiment 15.

Elevation of the write performance and reduction of the electricity consumption can be accomplished by forming the large width part 33 around a portion of the data electrode 16 corresponding to the above surface discharging gap 23 and the narrow width part 34 at a portion other than the large width part 33 as shown in FIG. 21.

In FIG. 21, the surface discharging electrode is formed by arranging the maintaining electrode 32, the scanning electrode 31, the scanning electrode 31 and the maintaining electrode 32 in this turn, and the arrangement of one of the two scanning electrode 31 and the corresponding maintaining electrode 32 are replaced with each other. Even in this arrangement, the large width part 33 and the narrow width part 34 of the data electrode 16 can be formed by attaching importance to the scanning electrode 31.

Since the AC-PDP of Embodiments 14 and 15 is constituted as described above, the efficiency of taking out the emitted beam is largely improved by employing the isolated bus electrode to generate the surface discharge acting as the maintaining discharge only on the transparent electrode 13 in addition to the effects of the preceding Embodiments.

Although the data electrode 16 of the above Embodiments has been described in which the width thereof is simply changed stepwise, the stepwise change is not necessary in the present invention and a continuous or linear change may be employed.

The positions or the shapes of the elements employable in the present invention are not restricted to those in the above Embodiments.

Since the above embodiments are described only for examples, the present invention is not limited to the above embodiments and various modifications or alternations can be easily made therefrom by those skilled in the art without departing from the scope of the present invention.

What is claimed is:

1. An AC plasma display panel (AC-PDP) comprising:

first and second glass substrates;

a plurality of partition walls sandwiched between said first glass substrate and said second glass substrate, said partition walls extending in a column direction to separate a plurality of discharge cells in a row direction;

a pair of transparent electrodes for extending in said row direction parallel to each other with a discharge gap therebetween in each of said discharge cells to operate surface discharge therebetween;

a plurality of metallic bus electrodes each disposed on said first glass substrate corresponding to each of said transparent electrodes, each of said transparent electrodes including a discharge part and a coupling part in each of said discharge cells, said coupling part coupling said discharge part to one of said metallic bus electrodes and coupling two of said discharge part disposed in adjacent two of said discharge cells; and a data electrode disposed on said second glass substrate to extend in each of said discharge cells in said column direction, said data electrode and said discharge part of a corresponding one of said transparent electrodes operating preliminary discharge therebetween, wherein said data electrode has a first width adjacent to said metallic bus electrode and a second width adjacent to said discharge part, said first width being smaller than said second width.

2. An AC plasma display panel (AC-PDP) comprising:

first and second glass substrates;

a plurality of partition walls sandwiched between said first glass substrate and said second glass substrate, said partition walls extending in a column direction to separate a plurality of discharge cells in a row direction;

a pair of transparent electrodes for extending in said row direction parallel to each other with a discharge gap therebetween in each of said discharge cells to operate surface discharge therebetween;

a plurality of metallic bus electrodes each disposed on said first glass substrate corresponding to each of said transparent electrodes, each of said transparent electrodes including a discharge part and a coupling part in each of said discharge cells, said coupling part coupling said discharge part to one of said metallic bus electrodes and coupling two of said discharge part disposed in adjacent two of said discharge cells; and a data electrode disposed on said second glass substrate to extend in each of said discharge cells in said column direction, said data electrode and said discharge part of a corresponding one of said transparent electrodes operating preliminary discharge therebetween, wherein said data electrode has a first width adjacent to said discharge gap and a second width adjacent to a gap between said transparent electrode and said metallic bus electrode, said first width being larger than said second width. coupling part and said metallic bus electrode are formed in a single layer.

3. An AC plasma display panel (AC-PDP) comprising first and second glass substrates;

a plurality of partition walls sandwiched between said first glass substrate and said second glass substrate, said partition walls extending in a column direction to separate a plurality of discharge cells in a row direction;

a pair of transparent electrodes for extending in said row direction parallel to each other with a discharge gap therebetween in each of said discharge cells to operate surface discharge therebetween; and a data electrode disposed on said second glass substrate to extend in each of said discharge cells in said column direction, said data electrode having a first width adjacent to said discharge gap and a second width adjacent to a side of said transparent electrode opposite to said discharge gap, said first width being larger than said second width.

4. The AC-PDP as defined in claim 3, wherein said data electrode has a large width portion adjacent to said discharge gap.

5. The AC-PDP as defined in claim 3, wherein said data electrode has a small width portion adjacent said side of said transparent electrode.

6. The AC-PDP as defined in claim 3, wherein said data electrode has a large width portion adjacent to said discharge gap, a small width portion adjacent to said side of said transparent electrode and has a medium width other than said large width portion and said small width portion.

7. The AC plasma display panel as claimed in claim 3, wherein said discharge gap extends in a direction of said scanning electrode between a pair of said transparent electrodes, and an isolated bus electrode electrically connected with an outer part of said transparent electrode by way of a coupling part extends in a direction of said scanning electrode.

* * * * *